US006508745B1

(12) United States Patent
Schenk et al.

(10) Patent No.: US 6,508,745 B1
(45) Date of Patent: Jan. 21, 2003

(54) STATIONARY EXERCISE BICYCLE WITH SHOCK ABSORPTION SYSTEM

(75) Inventors: Peter Schenk, 2730 Daybreaker Dr., Park City, UT (US) 84098; William E. Clem, Bozeman, MT (US); Cory Williamson, Bozeman, MT (US); Martin Albini, Bozeman, MT (US); Darius Eghbal, Bozeman, MT (US); Erik G. Green, Bozeman, MT (US)

(73) Assignee: Peter Schenk, Park City, UT (US)

( * ) Notice: Subject to any disclaimer, the term of this patent is extended or adjusted under 35 U.S.C. 154(b) by 0 days.

(21) Appl. No.: 09/249,923

(22) Filed: Feb. 12, 1999

(51) Int. Cl.[7] ..... A63B 22/06

(52) U.S. Cl. ..... 482/57; 482/63; 482/65; 482/96

(58) Field of Search ..... 482/51, 57–65, 482/71, 72, 95, 96; 434/61

(56) References Cited

U.S. PATENT DOCUMENTS 1,796,682 A * 3/1931 Bell ..... 482/57
6,126,577 A * 10/2000 Chang ..... 434/61
6,251,047 B1 * 6/2001 Stearns et al. ..... 482/4

* cited by examiner

*Primary Examiner*—Stephen R. Crow
*Assistant Examiner*—Tam Nguyen
(74) *Attorney, Agent, or Firm*—Pate Pierce & Baird

(57) ABSTRACT

A stationary exercise bicycle apparatus is provided, the apparatus including shock absorption capabilities in order to more completely simulate the movement and feel of an actual free standing bicycle. Shock absorption capabilities are provided by a rearwardly extending member having a first end which is pivotally secured to the base portion of the apparatus and a second end which includes a surface contacting roller.

Further, a resilient elastomeric component is provided which is disposed between brackets mounted on the rearwardly extending member and the base portion, respectively, this component being slightly compressed in response to the operator's weight and movements initiated by the operator. Such compression serves as a dampening or absorption of shock waves. Also, it will be recognized that the configuration described allows for some limited up and down movement of the apparatus.

15 Claims, 7 Drawing Sheets

STATIONARY EXERCISE BICYCLE WITH SHOCK ABSORPTION SYSTEM

BACKGROUND OF THE INVENTION

1. Field of the Invention

This invention relates primarily to stationary exercise equipment, such as bicycles, and more particularly to a novel stationary exercise bicycle apparatus which includes a shock absorption system for providing increased comfort and for providing an enhanced level of simulation of a traditional free-standing bicycle. One preferred embodiment of this invention further includes a rocking system which provides limited side to side movement of the apparatus.

2. Description of the Prior Art

In the last few decades, the exercise industry has grown tremendously due, in part, to an increased awareness and desire on the part of the public to achieve and maintain a higher level of athletic fitness and general well-being. Numerous apparatus and devices have been invented that purport to impart long life and health upon their users.

More specifically, stationary bicycles have grown in popularity, partly as a result of the increased popularity of specialty forms of bicycling, such as mountain biking and bicycle touring. Stationary bicycles supposedly give the user the feel of riding a real bicycle without the effort, maintenance and safety concerns associated therewith. But as many who have undertaken to ride a stationary bicycle have determined, most stationary bicycles are boring, resulting in large numbers of riders giving up on this activity.

In attempting to address this problem, there have been many who have invested large amounts of creativity, money and effort into making the stationary bicycle more tolerable to the average user. And many improvements have been made. For example, a form of exercise on a stationary bicycle that has recently caught on with the public is spinning, in which an instructor leads a pack of stationary cyclists through an artificial training workout that simulates a pack of actual riders engaged in an actual road workout. This form of exercise has become successful because the feeling of an actual riding experience is sought for and achieved to some degree.

However, there is at least one area in which little or no improvement has resulted, thus preventing stationary bicycles from becoming as popular or as widely accepted as they could be. The physical design of stationary bicycles typically provides for a stabile, ground contacting base upon which the body of the bicycle is rigidly mounted. While most have a seat, handlebars and pedals, in simulation of an actual bicycle, most do not make provision for other standard features and capabilities.

Real bicycles allow a rider to lean into turns, to tilt from side to side as he or she pumps the pedals through a difficult section of terrain, and to enjoy some dampening up and down movement from the bicycle's shock absorption system resulting in a more comfortable ride. However, these features are not found on the typical stationary exercise bicycle. Perhaps if they were, more bicycle enthusiasts would opt to spend more time enjoying the advantages of stationary bicycling.

Thus, there remains in the prior art a distinct and long-felt need for a stationary bicycle which incorporates as many of the features of a real bicycle as possible. Such a stationary exercise bicycle would reduce boredom while riding because it would more effectively simulate the enjoyable aspects of riding a actual bicycle.

BRIEF SUMMARY AND OBJECTS OF THE INVENTION

In light of the above referenced prior art problems, the present invention overcomes or substantially alleviates the problems and shortcomings of the prior art of exercise bicycle apparatus and the like, and seeks to accomplish and realize, among other things, the following objects and advantages.

A principal objective of the present invention is to satisfy the need for a stationary exercise bicycle apparatus that simulates the more enjoyable features of an actual bicycle.

Another principal objective of this invention is to provide a shock absorption system for a stationary exercise bicycle apparatus that provides the operator with some limited up and down movement in simulation of an actual bicycle.

A further major objective of the present invention is the provision of a stationary bicycle in which some limited side to side movement is allowed in simulation of an actual bicycle.

Another important objective of this invention is to provide a stationary exercise bicycle apparatus that is safe, easy to use, easy to manufacture, durable, economical, efficient, inexpensive, and fun for all users.

These and other objects, advantages and features of the current invention will become apparent to one skilled in the art by examination of the drawings and accompanying text which fully describe the manner of use and construction of the invention. Generally, the preferred embodiment of this invention includes a stabilizing base portion; a seat and a handlebar, both mounted onto the base portion; and a shock absorption system.

In brief, the shock absorption system comprises a rearwardly extending member having one end pivotally secured to the base portion. The other end includes a surface contacting roller, which allows the rearwardly extending member to translate up and down movement exerted by the operator into a horizontal rolling motion. Preferably, the shock absorption system also comprises an elastomeric component that is situated between the base portion and the rearwardly extending member. To aid this configuration, a bracket may be provided on the base portion and another bracket on the rearwardly extending member, the elastomeric member being disposed and secured therebetween. In this fashion, limited up and down motion is allowed by the apparatus in response to movement initiated by the operator and such up and down motion is absorbed and limited by the elastomeric member.

The base portion includes a plurality of contact points which communicate between the apparatus and a solid planar surface upon which the apparatus rests, as well as a drive system, including operator activated, oppositely aligned, rotating pedals. Advantageously, the base portion further includes a ground contacting transverse section to aid in the stabilization of the apparatus, the transverse section having an extremity on each side of the apparatus. One skilled in the art will recognize that a preferred placement of the contact points would be at or near each of the transverse extremities of the transverse section.

Furthermore, one skilled in the art will see and understand that contact points disposed at the transverse extremities may comprise an elastomeric, or similar, component which provides some limited side to side rocking movement of the apparatus as the operator shifts his or her weight from side to side. Also, it is advantageous to provide a ground surface contact point, which communicates between the apparatus and the solid planar surface on which it rests, on the transverse section of the base portion where the longitudinal axis bisects the transverse section.

As one skilled in the art will realize, and as the drawings indicate, the contact point located on the transverse section and the surface contacting roller of the rearwardly extending member combine to define an axis about which the apparatus can rock in simulation of an actual free standing bicycle. In this case, the contact points which are disposed at the extremities of the transverse section act to absorb and limit such rocking movement.

The drive system also includes a weighted wheel in communication with the pedals, the wheel having a magnetically attractive strip about its perimeter. Further, as with most stationary exercise bicycles, the drive system of this invention includes a mechanism for resistance, or, in other words, a mechanism for selectively requiring a force to be exerted by the operator in order to rotate the pedals.

This mechanism may vary in specifics from embodiment to embodiment, but in the most preferred embodiment includes the following essential components: an electromagnet aligned with the magnetically attractive strip on the wheel; a mechanism for adjusting, by selectively advancing and retracting, the electromagnet relative to the magnetically attractive strip; and a motor for supplying electric power to the electromagnet.

As mentioned above, the apparatus includes a handlebar, which may take any variety of functional sizes and shapes. Advantageously, the handlebar of this invention is adjustable about an axis that is transverse to the apparatus, thereby allowing the operator to find a comfortable position that aids in the usability of the apparatus.

DESCRIPTION OF THE DRAWINGS

In order that the manner in which the above-recited and other advantages and objects of the invention can be appreciated, a more particular description of the invention briefly described above will be rendered by reference to a number of specific embodiments which are which are illustrated in the appended drawings. Understanding that these drawings depict only typical embodiments of the invention and are not to be considered limiting in scope, the invention will be described and explained with additional specificity and detail through the use of the accompanying drawings, in which.

DETAILED DESCRIPTION OF THE PREFERRED EMBODIMENTS

Figure 1:
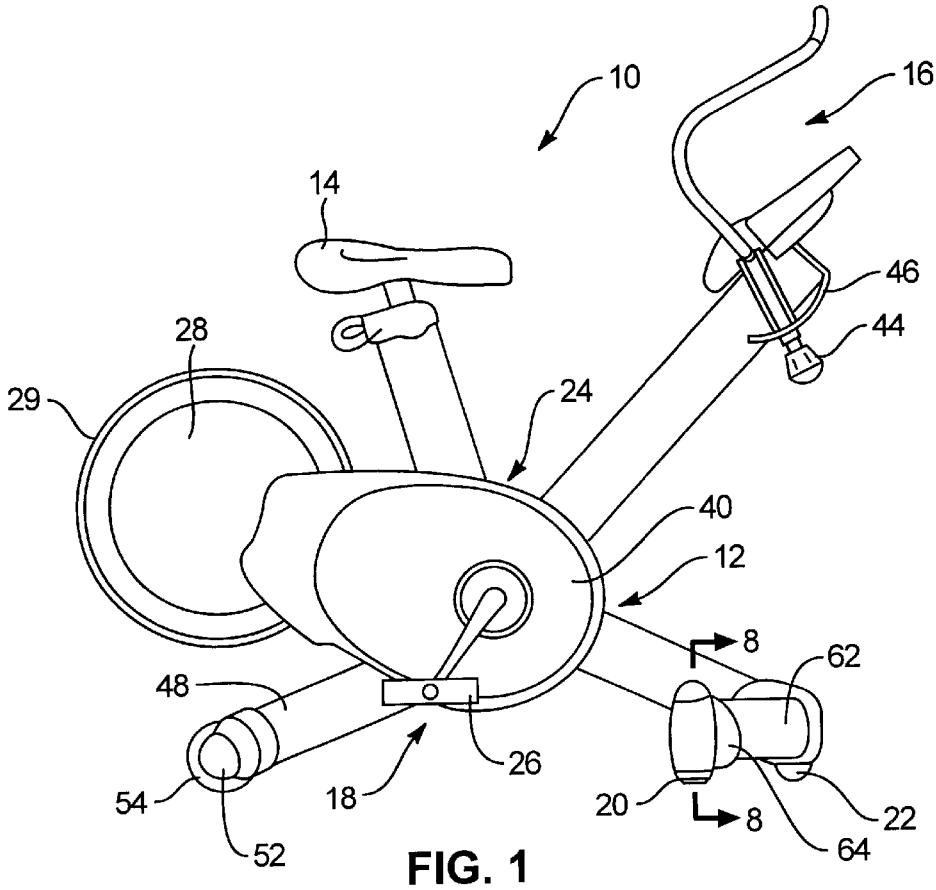
FIG. 1 is a side elevational view of one preferred embodiment of the present invention.

Reference is now made to the drawings, wherein like numerals are used to designate like components throughout. The apparatus in general, designated 10, comprises a stabilizing base portion 12, a seat 14 mounted onto the base portion 12, a handlebar 16 mounted onto the base portion 12, and a shock absorption system 18. Each of these components will be explained in greater detail hereinafter.

As illustrated in the drawings, the base portion 12 is constructed of a sturdy structural material, such as steel or aluminum, and includes a plurality of contact points 20 and 22, each of which provides communication between the appararus 10 and the solid planar surface upon which it rests. The base portion 12 further comprises a drive system 24, which includes operator activated rotating pedals 26 communicating with a weighted wheel 28 having a magnetically attractive strip 29 disposed completely about its perimeter.

The drive system 24 also includes a resistance system 30, which in turn comprises an electromagnet 32 that supplies an electromagnetic force to the strip 29 to provide resistance, an adjustment screw 34 and related housing for selectively advancing and retracting the electromagnet 32 relative to the strip 29, and an electric motor 36 for supplying power to the adjustment screw 34 and the electromagnet 32. One skilled in the art will recognize that this is advantageously accomplished by provision of small wheel 38, rotatably attached to the motor 36 and contacting the weighted wheel 28. In this configuration, the small wheel 38 is rotated by rotation of the weighted wheel 28 (rotated by the operator using the pedals 26), thereby creating an electrical force in the motor 36. Preferably, the drive system 24 is hidden from view and protected by a cover 40.

Figure 5:
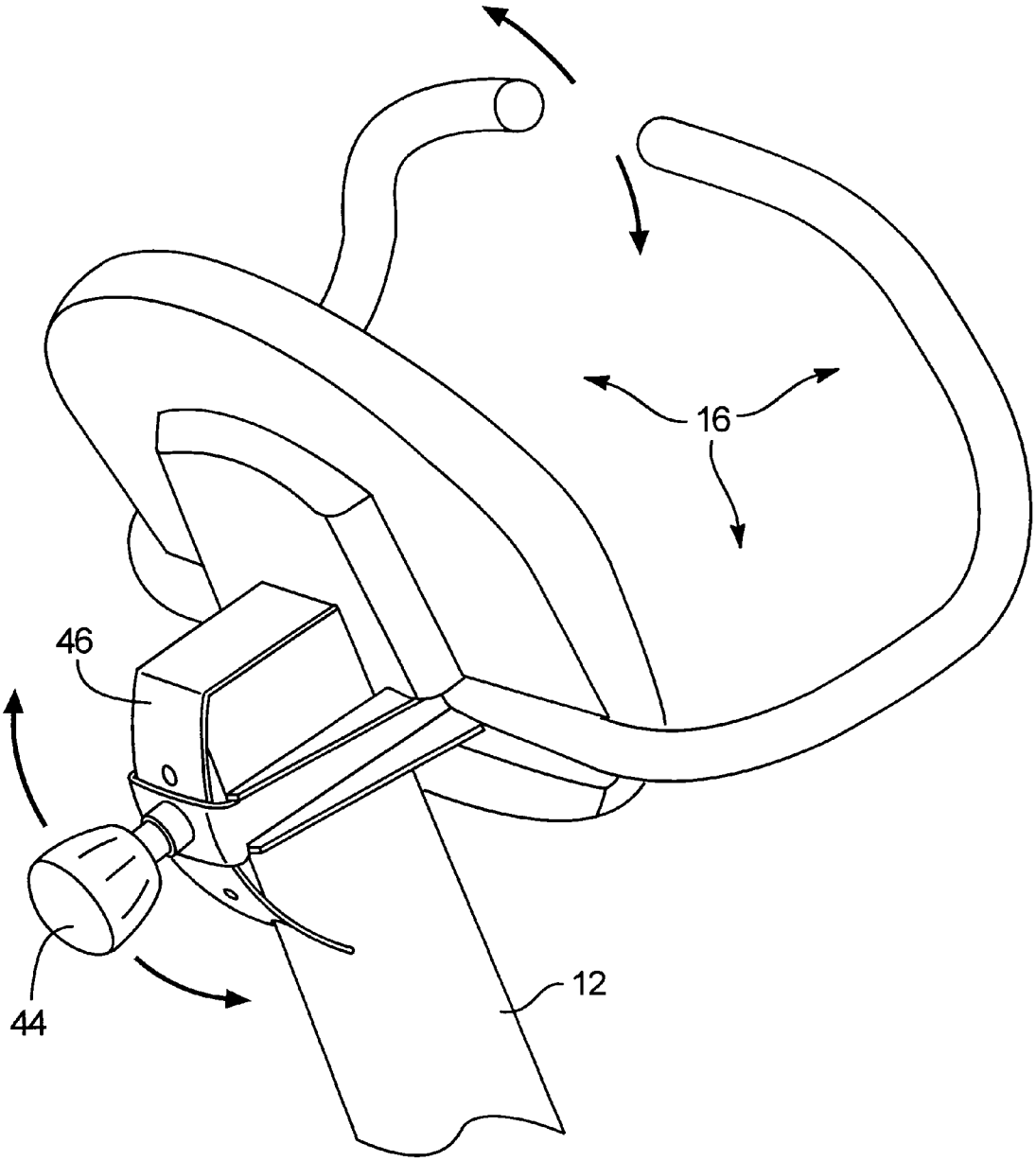
FIG. 5 is an enlarged cutaway perspective view of the handlebar portion of the embodiments of FIG. 1 and FIG. 4.

The handlebar 16 provides support for the hands and/or arms of the operator and advantageously may be adjusted to a comfortable position. As shown in FIG. 5, the preferred handlebar 16 rotates about a transverse axis 42, shown in FIG. 2 and is secured in place by a springed pin 44, which inserts into one of a series of apertures in a bracket 46 attached to an extension of the base portion 12.

Figure 6:
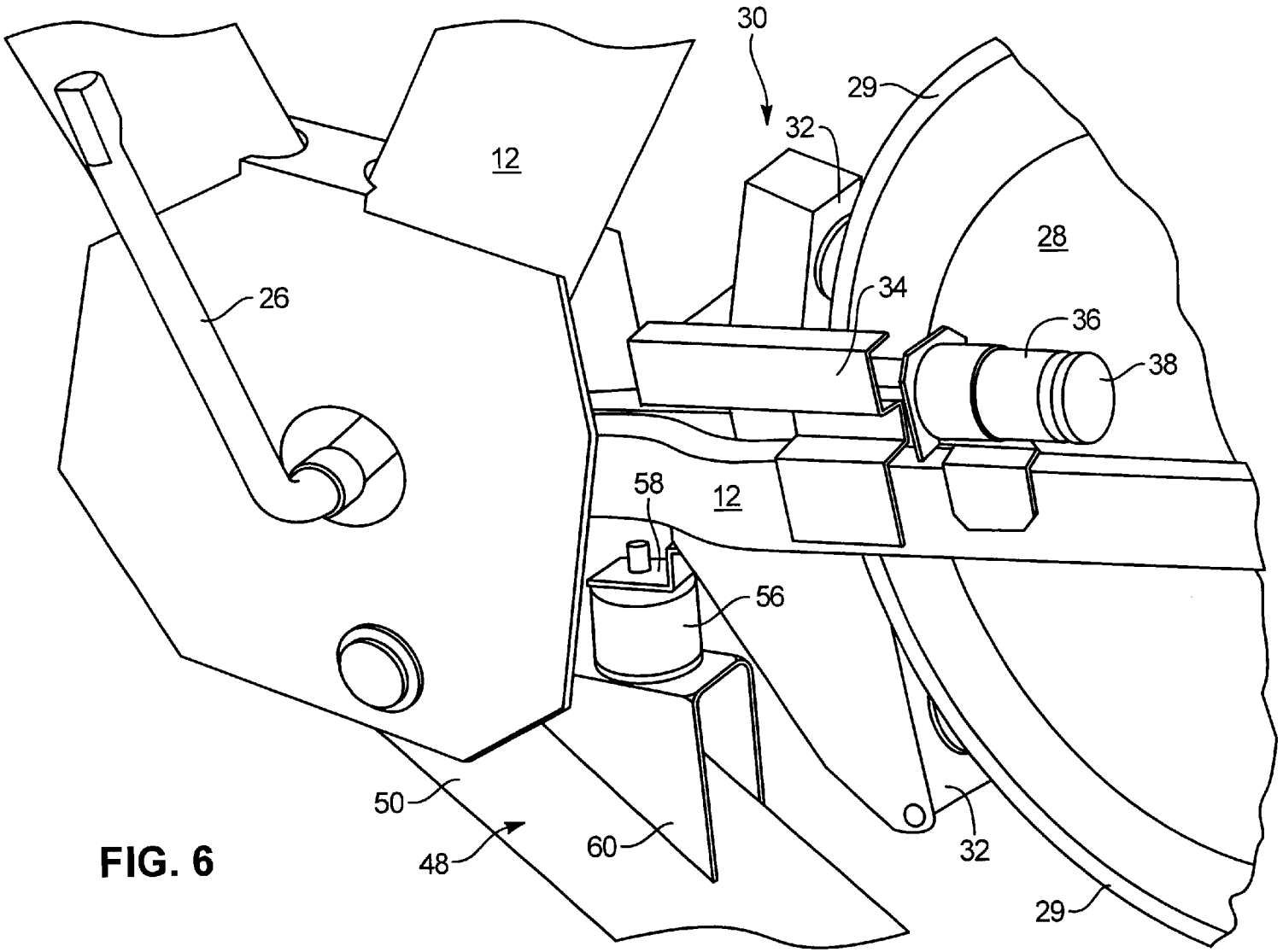
FIG. 6 is an enlarged cutaway perspective view of the drive system and the shock absorption system of the current invention.
Figure 7:
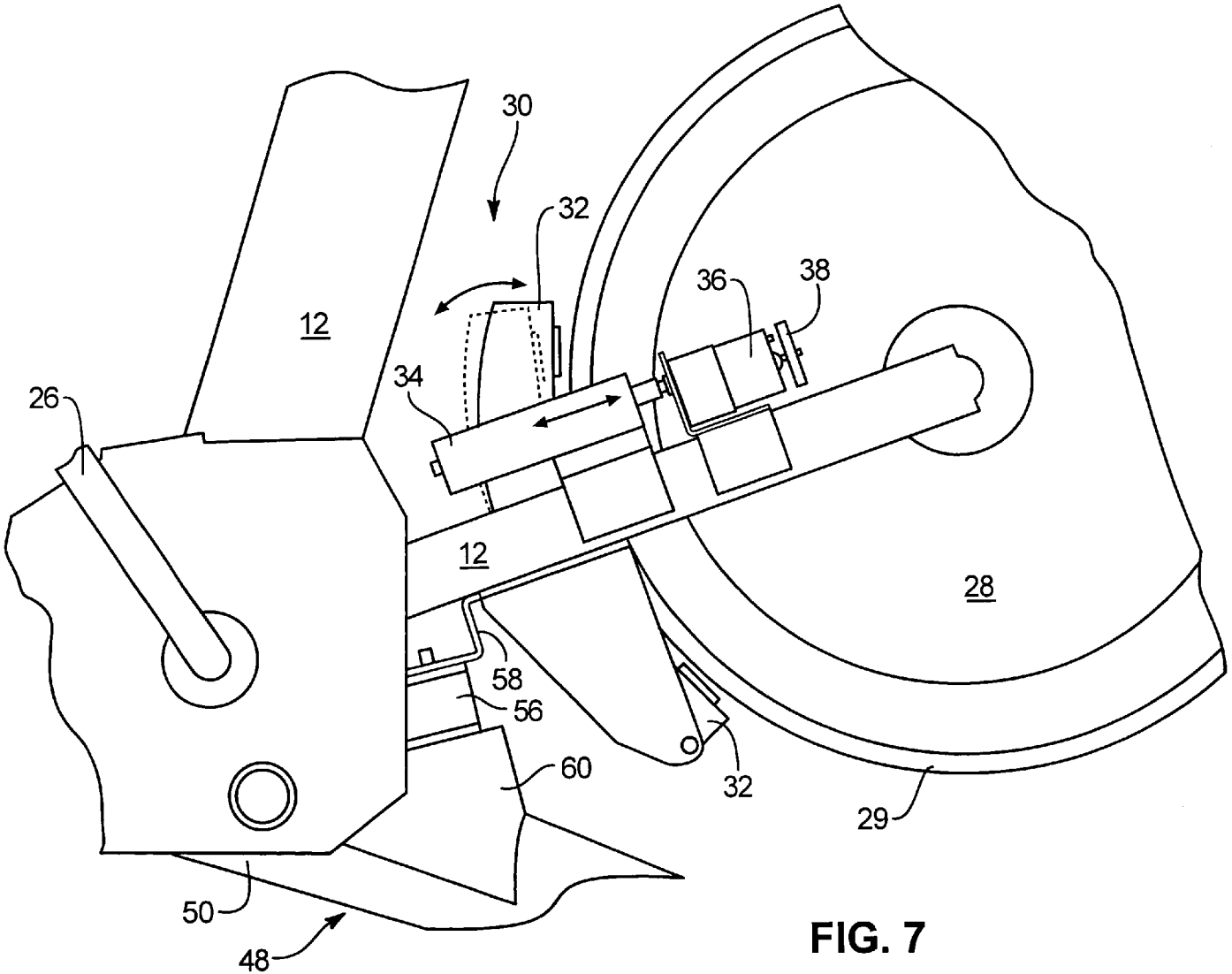
FIG. 7 is an enlarged cutaway side elevational view of the drive system and the shock absorption system of the current invention, illustrating the adjustability of the resistance system.
Figure 9:
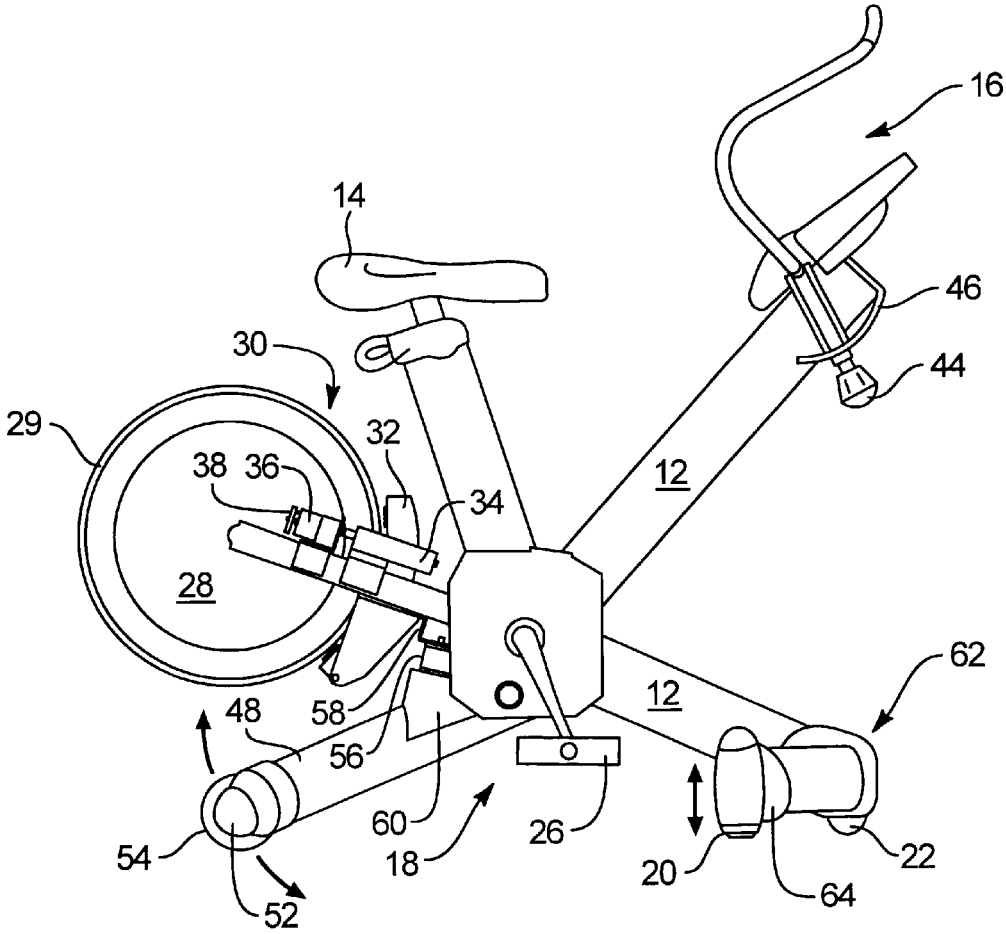
FIG. 9 is a side elevational view of the embodiment of FIG. 1 with arrows indicating the allowed motion of the apparatus responsive to the weight and movement of the operator.

The shock absorption system 18 comprises a rearwardly extending member 48 which has first and second ends 50 and 52, respectively. The first end 50, as best 15 seen in FIGS. 6, 7 and 9, is pivotally secured, as with a pivot pin, to the base portion 12, while the second end 52 includes a surface contacting roller 54. The shock absorption system 18 further comprises an elastomeric component 56 disposed between the base portion 12 and the rearwardly extending member 48. Brackets 58 and 60, mounted on the base portion 12 and the rearwardly extending member 48, respectively, aid in placing the elastomeric component 56 in a position in which limited up and down motion is allowed by the apparatus 10 in response to movement initiated by the operator and such up and down motion is absorbed and limited by the elastomeric component 56.

Figure 8:
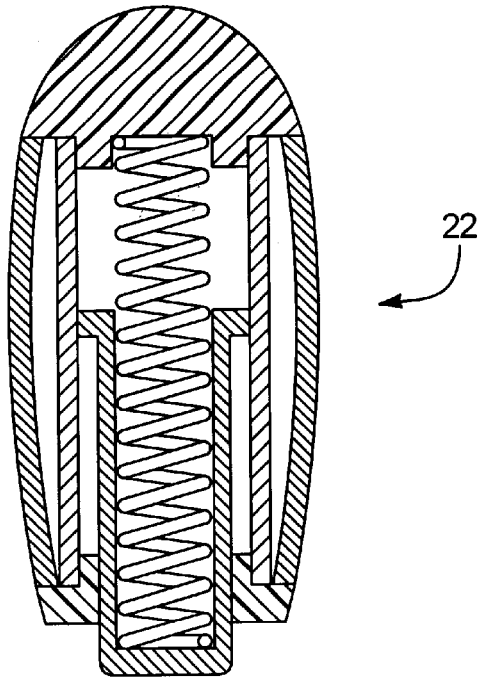
FIG. 8 is an enlarged cutaway side elevational view of one of the contact points disposed at a transverse extremity of the transverse section of the base portion, according to the present invention.

As mentioned above, the base portion 12 includes the contact points 20 and 22. Advantageously, the base portion further includes a transverse section 62, which aids in the stabilization of the apparatus 10. As one skilled in the art will readily understand, the transverse section 62 comprises a transverse extremity 64 on each side of the apparatus 10, each transverse extremity 64 including one of the contact points 20, as shown. One skilled in the art will further recognize that each of the contact points 20 may have a construction as illustrated in the cross section of FIG. 8 wherein some "give" is provided when a force is exerted. Thus, the contact points 20 are elastic and absorb some of the movement initiated by the operator. Also, as shown in FIGS. 9 and 10, the contact points 20 provide some limited side to side movement of the apparatus 10 in simulation of a real bicycle.

Figure 2:
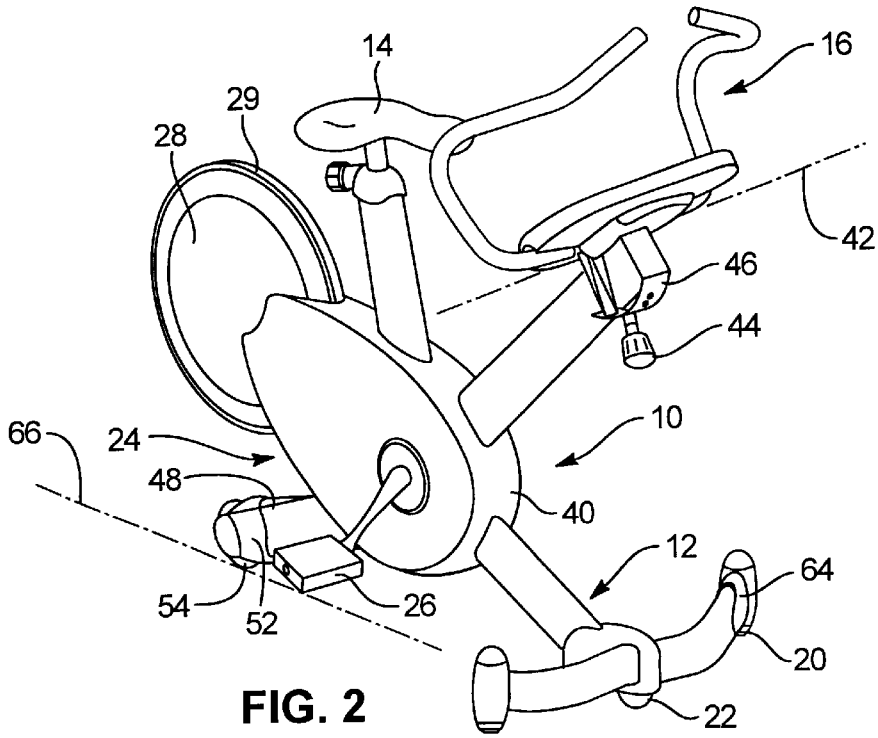
FIG. 2 is a front perspective view of the embodiment of the invention illustrated in FIG. 1.
Figure 3:
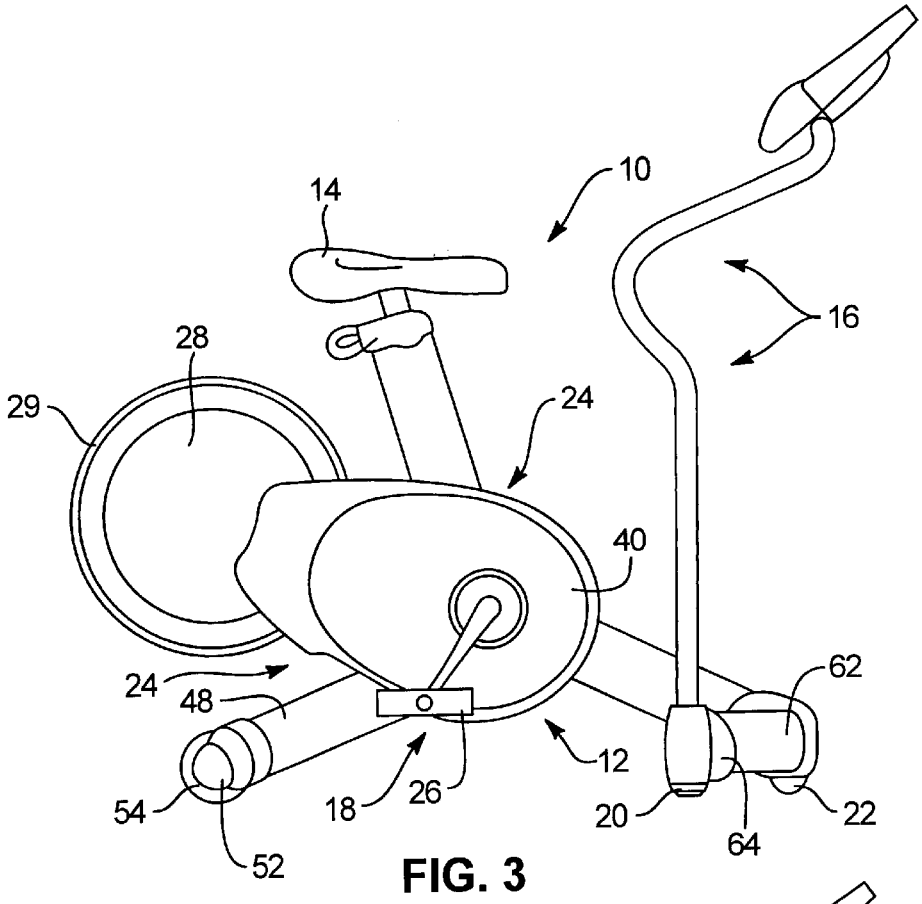
FIG. 3 is a side elevational view of another preferred embodiment of the present invention.
Figure 4:
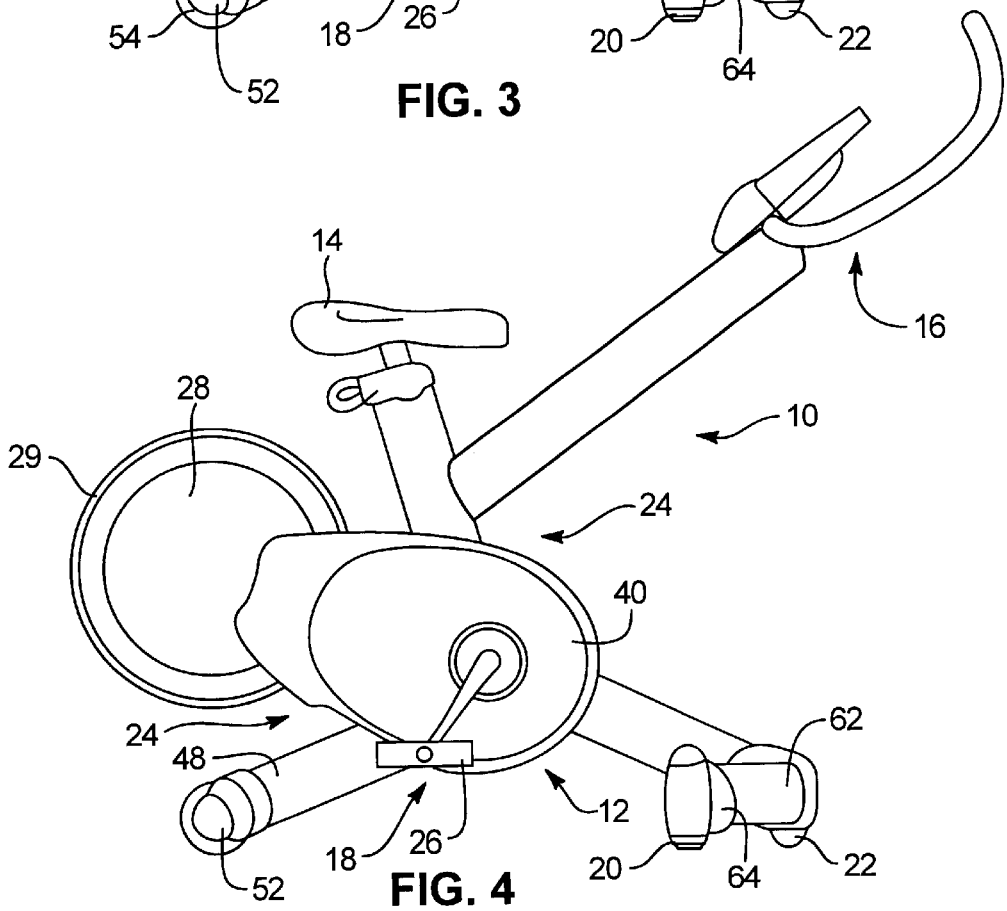
FIG. 4 is a side elevational view of still another preferred embodiment of the present invention.
Figure 10:
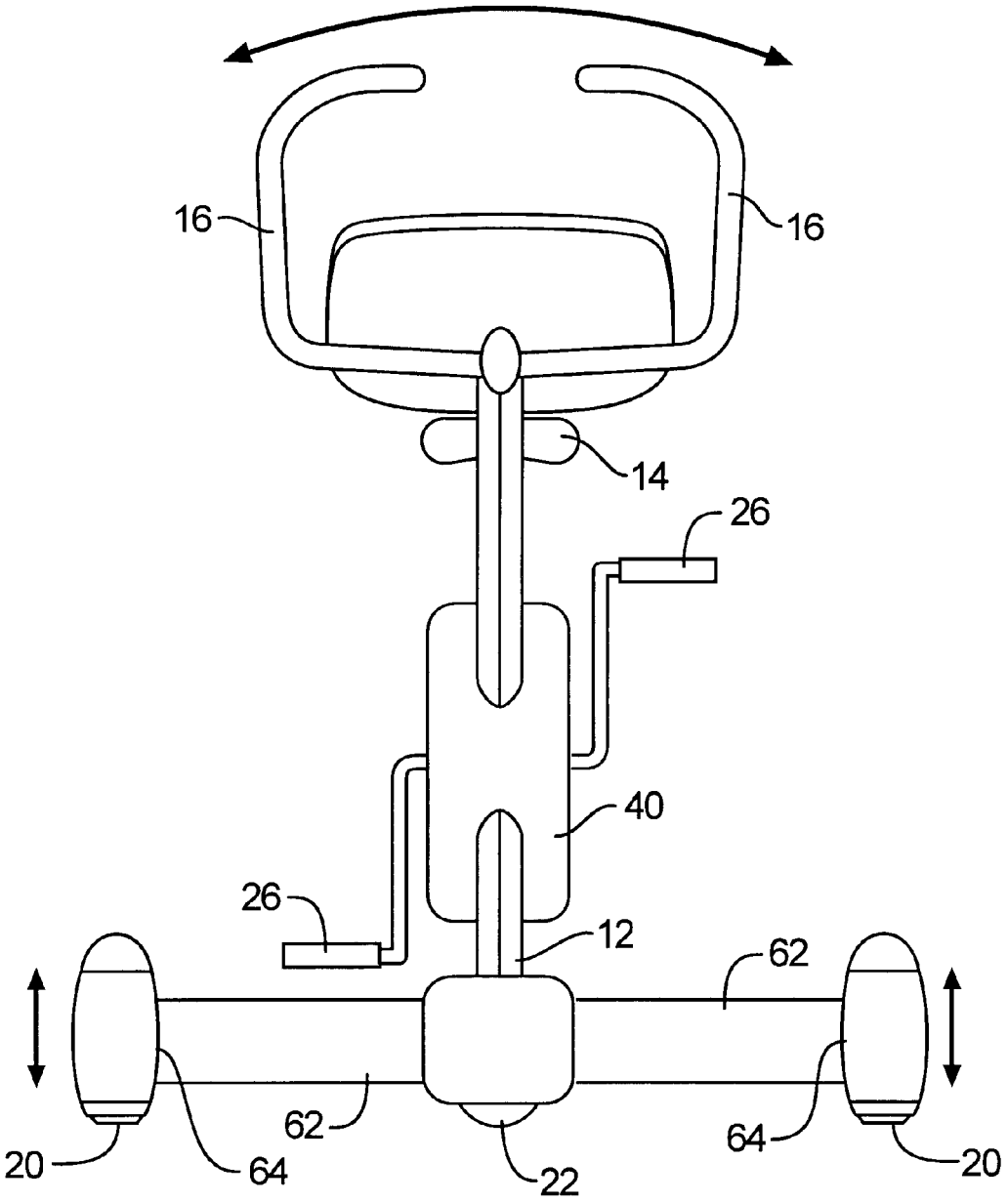
FIG. 10 is a front elevational view of the embodiment of FIG. 1 with arrows indicating the side to side tilting motion allowed by the apparatus responsive to the operator's weight and movement.

As illustrated in FIGS. 2 and 10, the contact point 22 is disposed on the transverse section 62 of the base portion 12 where the major longitudinal axis 66 bisects the transverse section 62. In this manner, the contact point 22 and the surface contacting roller 54 combine to define the axis 66 as an axis about which the apparatus 10 can rock side to side in simulation of an actual free standing bicycle, the contact points 22 serving to absorb and limit such rocking movement. One skilled in the art will observe that this forms an effective rocking system.

This invention may be embodied in other specific forms without departing from its spirit or essential characteristics. The described embodiments are to be considered in all respects as illustrative and not restrictive. The scope of the invention is, therefore, to be indicated by the appended claims rather than by the foregoing description. All changes which come within the meaning and range of equivalency of the claims are to be embraced within their scope.

What is claimed and desired to be secured by United States Letters Patent is:

1. A stationary exercise bicycle apparatus having shock absorption capabilities, the apparatus comprising:

a stabilizing base portion having a plurality of contact points for communication between the apparatus and a solid planar surface, the base portion further comprising a drive system, including operator activated rotating pedals, seat mounted onto the base portion, a handlebar mounted onto the base portion, and a shock absorption system comprising a rearwardly extending member wherein said member is free of any connections along its length with said drive system, having first and second ends, the first end being pivotally secured to the base portion and the second end including a roller that contacts said planar surface, the shock absorption system further comprising elastic means disposed between the base portion and the rearwardly extending member, such that limited up and down motion is allowed by the apparatus in response to movement initiated by the operator and such up and down motion is absorbed and limited by the elastic means.

2. A stationary exercise bicycle apparatus having shock absorption capabilities according to the limitations of claim 1, wherein the base portion includes a ground contacting transverse section to aid in the stabilization of the apparatus.

3. A stationary exercise bicycle apparatus having shock absorption capabilities according to the limitations of claim 2, wherein the transverse section of the base portion includes a transverse extremity on each side of the apparatus, each transverse extremity including at least one contact point for communication between the apparatus and the solid planar surface.

4. A stationary exercise bicycle apparatus having shock absorption capabilities according to the limitations of claim 3, wherein the contact points of the transverse extremities each comprise elastic means for absorption of some movement initiated by the operator.

5. A stationary exercise bicycle apparatus having shock absorption capabilities according to the limitations of claim 4, wherein the transverse section of the base portion is bisected by the major longitudinal axis of the apparatus, and a contact point for communication between the apparatus and the solid planar surface is disposed on the transverse section of the base portion where the longitudinal axis bisects the transverse section.

6. A stationary exercise bicycle apparatus having shock absorption capabilities according to the limitations of claim 5, wherein the contact point disposed on the transverse section where the longitudinal axis bisects the transverse section, together with the surface contacting roller, define an axis about which the apparatus can rock in simulation of an actual free standing bicycle, the contact points disposed at the extremities of the transverse section acting to absorb and limit such rocking movement.

7. A stationary exercise bicycle apparatus having shock absorption capabilities according to the limitations of claim 1, wherein the drive system further includes resistance means for selectively requiring a force to be exerted by the operator to rotate the pedals.

8. A stationary exercise bicycle apparatus having shock absorption capabilities according to the limitations of claim 7, wherein the drive system includes a weighted wheel in communication with the pedals, the wheel having a magnetically attractive strip about its perimeter, and the resistance means comprises:

magnetic attraction means for supplying a magnetic force to the magnetically attractive strip, adjustment means for selectively advancing and retracting the magnetic attraction means relative to the magnetically attractive strip, and powering means for supplying power to the adjustment means.

9. A stationary exercise bicycle apparatus having shock absorption capabilities according to the limitations of claim 1, wherein the handlebar is adjustable.

10. A stationary exercise bicycle apparatus having shock absorption capabilities according to the limitations of claim 9, wherein the adjustability of the handlebar is about an axis that is transverse to the apparatus.

11. A stationary exercise bicycle apparatus having shock absorption capabilities according to the limitations of claim 1, wherein the elastic means comprises a pair of corresponding, oppositely disposed brackets and an elastomeric component which is disposed between the brackets.

12. A stationary exercise bicycle apparatus which simulates the feeling of riding an actual free standing bicycle, the apparatus including shock absorption and rocking capabilities and comprising a drive system that includes operator activated rotating pedals:

a stabilizing base portion which includes a bisecting transverse section, the transverse section including a transverse extremity on each side of the apparatus, a seat mounted on the base portion, a handlebar mounted on the base portion, a shock absorption system comprising a rearwardly extending member having first and second ends, the first end being pivotally secured to the base portion and the second end including a roller that contacts said planar surface wherein said rearwardly extending member is free of any connections along its length with said drive system, the shock absorption system further comprising first elastic means disposed between the base portion and the rearwardly extending member, and a rocking system comprising two pivot points, the first pivot point being the surface contacting roller and the second pivot point being a surface contact point disposed where the major longitudinal axis of the apparatus is bisected by the transverse section of the base portion, the rocking system further comprising a contact point disposed at each of the transverse extremities of the transverse section, the contact points at the transverse extremities each including second elastic means, the first and second elastic means absorb and limit up and down and side to side movement, respectively, initiated by an operator.

13. A stationary exercise bicycle apparatus which simulates the feeling of riding an actual free standing bicycle according to the limitations of claim 12, wherein the first elastic means comprises a pair of corresponding, oppositely disposed brackets and an elastomeric component which is disposed between the brackets, the elastomeric member being springy and resilient.

14. A stationary exercise bicycle apparatus which simulates the feeling of riding an actual free standing bicycle according to the limitations of claim 13, wherein one of the brackets is mounted on the rearwardly extending member and the other bracket is mounted on the base portion, such that the weight of and movements initiated by the operator cause the elastomeric member to compress.

15. A stationary exercise bicycle apparatus which simulates the feeling of riding an actual free standing bicycle according to the limitations of claim 13, wherein the drive system further includes:

a weighted wheel in communication with the pedals, the wheel having a magnetic strip about its perimeter, and resistance means comprising magnetic attraction means for supplying a magnetic force to the magnetically attractive strip, adjustment means for selectively advancing and retracting the magnetic attraction means relative to the magnetically attractive strip, and powering means for supplying power to the adjustment means.

* * * * *